US006513428B1

(12) United States Patent
Sappal et al.

(10) Patent No.: US 6,513,428 B1
(45) Date of Patent: Feb. 4, 2003

(54) DEVICE AND METHOD FOR ATTACHING A PRINTING WEB TO A WEBBING SAIL AND DEVICE AND METHOD FOR WEBBING-UP A PRINTING MACHINE

(75) Inventors: Jatinder Singh Sappal, Rochester, NH (US); Mark Anthony Wingate, Rochester, NH (US); Matthew Jon Wingate, Durham, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/910,750

(22) Filed: Jul. 23, 2001

(51) Int. Cl.[7] ..... B41F 13/03

(52) U.S. Cl. ..... 101/228; 101/219; 226/91; 226/92

(58) Field of Search ..... 101/219, 225, 101/227, 228; 226/91, 92

(56) References Cited

U.S. PATENT DOCUMENTS 4,161,269 A * 7/1979 Kirkpatrick ..... 226/92
4,309,830 A * 1/1982 Vits ..... 226/92
4,693,405 A * 9/1987 Masse ..... 162/283
4,706,862 A * 11/1987 Theilacker ..... 101/228
6,161,604 A 12/2000 Richards et al.
6,223,962 B1 5/2001 Pimpis

FOREIGN PATENT DOCUMENTS

DE 198 37 361 A1 2/2000
DE 198 37 362 A1 2/2000

* cited by examiner

*Primary Examiner*—Andrew H. Hirshfeld
*Assistant Examiner*—Jill E Culler
(74) *Attorney, Agent, or Firm*—Laurence A. Greenberg; Werner H. Stemer; Ralph E. Locher

(57) ABSTRACT

A device and a method for attaching a printing web to a webbing sail include two thin, flexible sheets to be sandwiched about the printing web. Each of the sheets is at least partly attached to a trailing edge of the webbing sail. Protrusions are disposed obliquely on the sheets for gripping the printing web. A device and a method for webbing-up a printing machine are also provided.

24 Claims, 1 Drawing Sheet

DEVICE AND METHOD FOR ATTACHING A PRINTING WEB TO A WEBBING SAIL AND DEVICE AND METHOD FOR WEBBING-UP A PRINTING MACHINE

BACKGROUND OF THE INVENTION

Field of the Invention

The invention relates to a device and a method for attaching a printing web to a webbing sail and a device and a method for webbing-up a printing machine.

Automatic webbing systems have been incorporated into web-fed printing presses to reduce the time it takes to web a press by hand. Webbing devices or sails that are attached to such systems are used to pull the web through the press. Double-sided tape is typically used to attach a web to the webbing sail. Unfortunately, two types of tape exist, the easily removable and not so easily removable. If the wrong tape is used, it is extremely difficult to remove the web from the sail. After many web-ups, the tape begins to build up on the sail, possibly preventing it from fitting between a blanket-to-blanket nip. In addition, if the web is skewed while it comes in contact with the tape, there is no opportunity to reposition it. If the web and the sail are skewed, a shear force will be applied to the web as it is pulled through the press, causing web breaks.

Spatial constraints restrict the overall thickness of the web and the sail. Together, the combined thickness of the web and the sail must be less than 0.094 inches (2.4 mm) which is the gap between upper and lower blanket cylinders for both Commercial and Newspaper presses produced by Heidelberg Web Systems.

A device used by MAN-Roland attaches a web to a webbing device by using two thin magnetic sheets which sandwich the web therebetween. However, magnetic attraction may be insufficient to provide the required holding force to prevent the web from slipping out. Magnetized material may also facilitate the transfer of small metallic debris from one area of the press to another.

German Published, Non-Prosecuted Patent Application DE 198 37 361 A1 discloses a device for drawing a paper web into a printing machine. The web is provided with a draw-in tip having a wedge-shaped reinforced element coupled to a draw-in device by hook and eye, magnetic or snap fasteners. The web may be fastened to the reinforced element by an adhesive strip or plug-in tongue. In another embodiment, the web is placed over a female element and engaging pieces on a male element pierce the web and enter openings in the female element. The elements are connected to each other mechanically, by a snap closure or by a hook and eye closure.

German Published, Non-Prosecuted Patent Application DE 198 37 362 A1 discloses another device for drawing a paper web into a printing machine. A web is placed between male and female so elements. The male element has shaped elements in the form of triangles, cones, pyramids or cylinders or irregular shapes and the female element has depressions with matching shapes, between which the web is placed. The elements are clamped together magnetically by a snap closure, a spring force or a hook and eye closure. In another embodiment, cylindrical rods in a fan shape are connected to the web by placing hoses over the web and the rods.

The engaging pieces as well as the shaped elements and matching depressions all require external measures which act mechanically with a snap closure, with a hook and eye closure or with spring force to hold them in place on the web. As the webbing sail is pulled and increased tension is placed on the web, those devices tend to loosen around the web and/or tear the web. In addition, the use of such external measures is cumbersome and time-consuming.

SUMMARY OF THE INVENTION

It is accordingly an object of the invention to provide a device and a method for attaching a printing web to a webbing sail and a device and a method for webbing-up a printing machine, which overcome the hereinafore-mentioned disadvantages of the heretofore-known devices and methods of to this general type and which use mechanical measures to quickly and accurately attach, and if necessary reposition, a web to a webbing device without the use of external measures, without the use of a consumable, such as double-sided tape, and while minimizing the danger of loosening and/or tearing the web.

With the foregoing and other objects in view there is provided, in accordance with the invention, a device for attaching a printing web to a webbing sail having a trailing edge. The device comprises two thin, flexible sheets to allow wrapping around various rolls. At least one edge of the sheets is connected to the trailing edge of the webbing sail. The sheets are to be sandwiched about the printing web for attaching the printing web to the trailing edge of the webbing sail. Protrusions are obliquely disposed on the sheets, for instance toward a web travel direction, for gripping the printing web with increased force as the webbing sail pulls the printing web with increased tension, thereby tending to draw the two sheets together.

In accordance with another feature of the invention, the protrusions are points, such as corners of triangles, punched into the sheets. The triangles may be stamped through the sheets at an angle relative to the web travel direction.

In accordance with a further feature of the invention, the webbing sail may be formed of PVC material and the sheets may be formed of stainless steel.

In accordance with an added feature of the invention, one of the sheets is directly attached to the webbing sail and a flexible piece connects the other of the sheets to the webbing sail.

In accordance with an additional feature of the invention, the protrusions are staggered on the respective sheets and the sheets have holes formed therein between the protrusions. The protrusions on each of the sheets extend into the holes in the other of the sheets. Layers of a compressible material are each disposed on a respective one of the sheets for receiving ends of the protrusions passing through the holes.

With the objects of the invention in view, there is also provided a method for attaching a printing web to a webbing sail having a trailing edge. The method comprises providing two thin, flexible sheets having protrusions obliquely disposed thereon, for instance toward a web travel direction. At least one edge of the sheets is connected to the trailing edge of the webbing sail. The printing web is sandwiched between the two sheets for attaching the printing web to the trailing edge of the webbing sail. The printing web is gripped by the protrusions with increasing force as the webbing sail pulls the printing web through the printing machine with increasing tension.

With the objects of the invention in view, there is additionally provided a device for webbing-up a printing machine, comprising a thin, flexible webbing sail to be pulled through the printing machine. Two thin, flexible sheets are to be sandwiched about a printing web. At least one edge of the sheets is attached to the trailing edge of the webbing sail. Protrusions are obliquely disposed on the sheets, for instance toward a web travel direction, for gripping the printing web with increased force as the webbing sail pulls the printing web with increased tension.

With the objects of the invention in view, there is furthermore provided a method for webbing-up a printing machine, which comprises providing a webbing sail having a trailing edge. Protrusions are obliquely formed on two thin, flexible sheets, for instance toward a web travel direction and clearance holes aligned with the protrusions are formed in the opposite sheet. At least one edge of the sheets is attached to the trailing edge of the webbing sail. A printing web is sandwiched between the two sheets and the printing web is pulled through the printing machine with the webbing sail while gripping the printing web with the protrusions with increasing force as the webbing sail pulls the printing web through the printing machine with increasing tension.

Other features which are considered as characteristic for the invention are set forth in the appended claims.

Although the invention is illustrated and described herein as embodied in a device and a method for attaching a printing web to a webbing sail and a device and a method for webbing-up a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
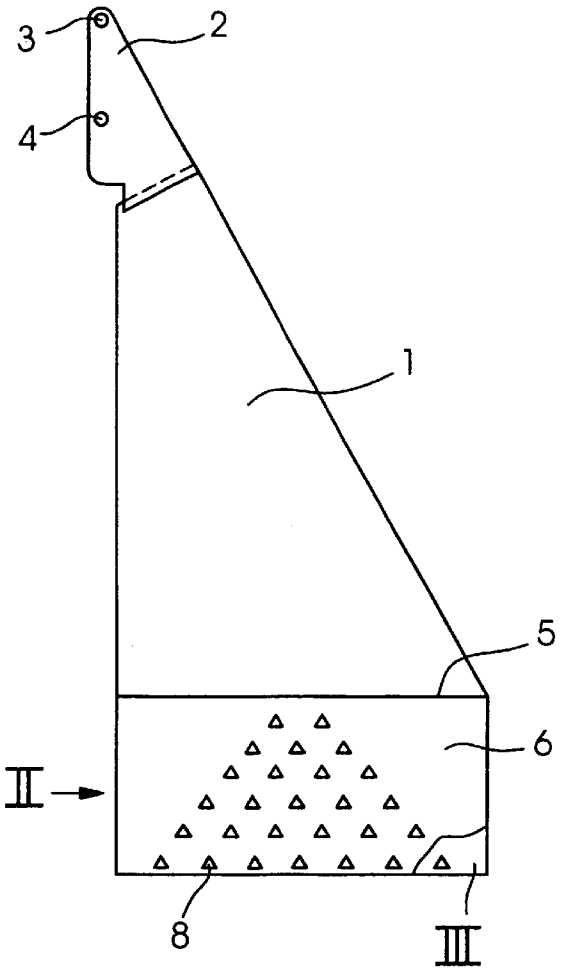
FIG. 1 is a diagrammatic, plan view of a webbing device according to the invention.

Referring now to the figures of the drawings in detail and first, particularly, to FIG. 1 thereof, there is seen a webbing sail 1, which may be made of PVC material or another thin, flexible material. An attachment piece 2 formed of 301 stainless steel or other suitable material which is approximately 0.012" (0.3mm) thick is fastened to the webbing sail 1. The attachment piece 2 has two attachment locations 3, 4 for attaching the web sail to an automatic webbing system for pulling a web through a printing press.

Figure 2:
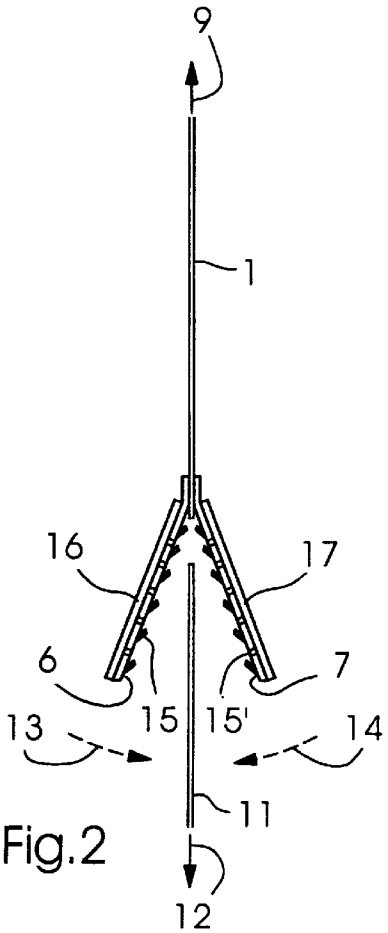
FIG. 2 is a side-elevational view of the webbing device, as seen in a direction of an arrow II of FIG. 1.

As is seen in FIGS. 1 and 2, two thin, flexible sheets 6, 7 of 301 stainless steel or other suitable material that is approximately 0.012" (0.3mm) thick, is the width of the webbing sail 1 and is approximately 2 to 3 feet (0.6 to 0.9 meters) in length, are bonded to a trailing edge 5 of the webbing sail 1. In order to hold the web, small staggered triangles 8 are stamped into the thin, flexible stainless steel sheets 6, 7 to produce raised triangles bent inward towards the trailing edge of the webbing sail 1. An end of a web 11 is placed between the thin, flexible sheets 6, 7. As the webbing sail 1 is pulled in the direction of web travel indicated by an arrow 9, the web 11 is tensioned in the direction of an arrow 12.

The raised staggered triangles 8 resemble teeth in a shark's jaw which are angled towards the back of the mouth to prevent prey from escaping once the mouth is closed. Much the same way, protrusions in the form of staggered points 15 of the triangles 8 in each sheet will pierce the web and prevent it from being pulled out of the webbing sail 1. The opposing staggered points 15 of the triangles 8 or teeth in each stainless steel sheet 6, 7 will tend to draw the two sheets together as indicated by arrows 13, 14 as web tension increases. This is due to the rake angle of the points 15 of the triangles 8. The points 15 need not be sharp, but instead may be oblong or have a radius tip to prevent a safety hazard.

The staggered points 15 in the thin, flexible sheets 6, 7 enter clearance holes 15' in the respective opposing thin, flexible sheets 7, 6. The length of the points 15 may be limited to prevent them from extending beyond the holes 15' in the opposing sheet, so that they are not worn away and do not damage lead rolls around which they pass in the printing machine. Alternatively, thin layers or films 16, 17 of compressible plastic, foam or urethane may be bonded to the thin, flexible metal sheets 6, 7 to receive the points 15 passing through the holes 15'.

Figure 3A:
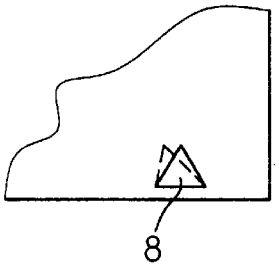
FIG. 3*a* is a fragmentary, enlarged plan view of a portion III of the webbing device of FIG. 1.
Figure 3B:
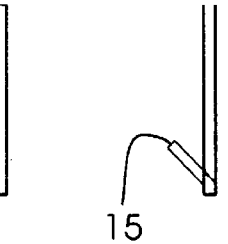
FIG. 3*b* is a fragmentary, side-elevational view of the portion III of FIG. 3*a*.

As a further refinement of the invention, the points 15 of the triangles 8 may be stamped into the sheets 6, 7 at a slight angle to the direction of web travel 9, as is indicated in FIG. 3*a*. This may aide in more accurately aligning the points with a side pull produced by pulling the web from only one side.

Figure 4:
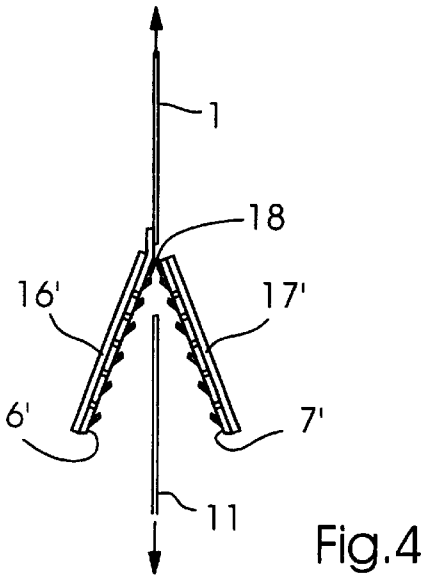
FIG. 4 is a view similar to FIG. 1 of another embodiment of the webbing device according to the invention.

The embodiment of FIG. 4 differs from that of FIG. 1 in that only one thin, flexible metal sheet 6' is attached to the trailing edge of the webbing sail 1 whereas another thin, flexible metal sheet 71 is attached to the thin, flexible metal sheet 6' by a flexible piece of plastic 18. The piece of plastic 18 allows a hinging action to occur between the metal sheets 6', 7' to lock the points 15 of the triangles 8 together. Thin layers or films 16', 17' of compressible plastic, foam or urethane may be bonded to the thin, flexible metal sheets 6', 7' to receive the points 15 passing through the holes 15'.

We claim:

1. A device for attaching a printing web to a webbing sail having a trailing edge, the device comprising:

two flexible sheets at least partly connected to the trailing edge of the webbing sail, said sheets to be sandwiched about the printing web for attaching the printing web to the trailing edge of the webbing sail; and protrusions obliquely disposed on said sheets and bent inward toward the trailing edge of the webbing sail for gripping the printing web with increased force as the webbing sail pulls the printing web with increased tension.

2. The device according to claim 1, wherein said protrusions are angled toward a web travel direction.

3. The device according to claim 1, wherein said protrusions are points punched in said sheets.

4. The device according to claim 3, wherein said points are corners of triangles punched into said sheets.

5. The device according to claim 4, wherein said points of said triangles are stamped through said sheets at an angle relative to a web travel direction.

6. The device according to claim 1, wherein the webbing sail is formed of PVC material.

7. The device according to claim 1, wherein said sheets are formed of stainless steel.

8. The device according to claim 1, wherein each of said sheets has one edge attached to the trailing edge of the webbing sail.

9. The device according to claim 1, wherein one of said sheets is directly attached to the webbing sail and a flexible piece connects the other of said sheets to the webbing sail.

10. The device according to claim 1, wherein said protrusions are staggered on said respective sheets, said sheets have holes formed therein between said protrusions, and said protrusions on each of said sheets extend into said holes in the other of said sheets.

11. The device according to claim 10, including compressible layers each disposed on a respective one of said sheets for receiving ends of said protrusions passing through said holes.

12. A method for attaching a printing web to a webbing sail having a trailing edge, the method comprising:

providing two flexible sheets at least partly connected to the trailing edge of the webbing sail and having protrusions obliquely disposed thereon and bent inward toward the trailing edge of the webbing sail;

sandwiching the printing web between the two sheets for attaching the printing web to the trailing edge of the webbing sail; and gripping the printing web with the protrusions with increasing force as the webbing sail pulls the printing web through the printing machine with increasing tension.

13. The method according to claim 12, which further comprises orienting the protrusions toward a web travel direction.

14. The method according to claim 12, which further comprises punching the protrusions in the sheets as points.

15. The method according to claim 12, which further comprises providing the points in the sheets as corners of triangles punched into the sheets.

16. The method according to claim 15, which further comprises stamping the points of the triangles through the sheets at an angle relative to a web travel direction.

17. The method according to claim 12, which further comprises forming the webbing sail of PVC material.

18. The method according to claim 12, which further comprises forming the sheets of stainless steel.

19. The method according to claim 12, which further comprises attaching one edge of each of the sheets to the trailing edge of the webbing sail.

20. The method according to claim 12, which further comprises directly attaching one of the sheets to the webbing sail, and connecting the other of the sheets to the webbing sail with a flexible piece.

21. The method according to claim 12, which further comprises staggering the protrusions on the respective sheets, forming holes in the sheets between the protrusions, and pushing the protrusions on each of the sheets into the holes in the other of the sheets.

22. The method according to claim 21, which further comprises placing a respective compressible layer on each of the sheets for receiving ends of the protrusions passing through the holes.

23. A method for webbing-up a printing machine, which comprises:

providing a webbing sail having a trailing edge;

obliquely forming protrusions on two flexible sheets wherein each protrusion is bent inward toward the trailing edge of the webbing sail;

at least partly attaching the two sheets to the trailing edge of the webbing sail;

sandwiching a printing web between the two sheets; and pulling the printing web through the printing machine with the webbing sail while gripping the printing web with the protrusions with increasing force as the webbing sail pulls the printing web through the printing machine with increasing tension.

24. The method according to claim 23, which further comprises attaching one edge of each of the sheets to the trailing edge of the webbing sail.

* * * * *